United States Patent [19]

Mazzeo et al.

[11] 4,226,494

[45] Oct. 7, 1980

[54] CIRCUIT PANEL CONNECTOR

[75] Inventors: Charles F. Mazzeo, Scotch Plains; Catherine K. Cotler, Cranford, both of N.J.

[73] Assignee: Amerace Corporation, New York, N.Y.

[21] Appl. No.: 974,087

[22] Filed: Dec. 28, 1978

[51] Int. Cl.[2] ..... H01R 13/58

[52] U.S. Cl. ..... 339/103 R; 339/64 M; 339/107

[58] Field of Search ..... 339/103, 107, 64 M

[56] References Cited

U.S. PATENT DOCUMENTS

| | | | |
|---|---|---|---|
| 3,920,306 | 11/1975 | Barnett, Jr. et al. | 339/107 X |
| 3,994,555 | 11/1976 | Konno et al. | 339/103 R |
| 4,037,906 | 7/1977 | Jayne | 339/107 |

*Primary Examiner*—Roy Lake
*Assistant Examiner*—DeWalden W. Jones
*Attorney, Agent, or Firm*—Richard A. Craig

[57] ABSTRACT

Disclosed herein is a circuit panel connector for electrically connecting a circuit panel, such as a printed circuit board, with an insulated wire. The panel connector comprises a one-piece connector body of dielectric material having a main portion and a cover portion. The main portion includes a socket for receiving the panel, a rear wall, a floor, a pair of spaced side walls ech unitary with the rear wall and with the floor and providing the main portion with a cell. The main portion also has an opening in open communication with the cell and the socket and each side wall has a corner provided with a projection having an eave confronting the floor. The cover portion is hingedly connected to the rear wall and is movable between an open position in which the cover portion does not cover the cell and a closed position in which the cover portion covers the cell. The cover portion also has latching and strain relief resilient projection means. The latching projection means has a configuration adapted for latching interengagement with the eaves to hold the cover portion in the closed position and the strain relief projection means is located closer to the rear wall than the latching projection means and is adapted, when the cover portion is in the closed position, to engage the insulation of a wire in the cell, to provide strain relief.

15 Claims, 6 Drawing Figures

10
12
16
18
20
22
24
26
28
30
32
34
36
38
40
42
44
46
48
50
52
54
56
58
60
64
66
68
70

CIRCUIT PANEL CONNECTOR

BACKGROUND OF THE INVENTION

The present invention relates to circuit panel connectors for connecting circuit panels, such as printed circuit boards, with insulated wires.

More particularly, the invention relates to such a circuit panel connector comprising a one-piece connector body of dielectric material and a plurality of one-piece, electrically conductive terminals. The connector body has a cover portion which latches shut and incorporates an automatic strain relief feature. The terminals are of the insulation-piercing type.

The present invention is an improvement in several ways over the prior art as typified by Obuch et al U.S. Pat. No. 3,930,706, commonly assigned herewith. The device of the patent does not provide strain relief, involves multi-part terminals including tubular conductor-receiving members, conductor-clamping screws and a multi-part connector body of dielectric material.

In contrast, the present invention has the advantages of providing a greatly simplified and cheaper device which includes automatic, self-adjusting strain relief in a one-part connector body and one-part terminals which eliminate conductor-clamping screws, thus enabling a reduction in circuit spacing.

Accordingly, important objects of the present invention are to provide an improved circuit panel connector having the above advantages.

SUMMARY OF THE INVENTION

The present invention may be summarized as a circuit panel connector for electrically connecting a circuit panel, such as a printed circuit board, with an insulated wire, the panel connector comprising a connector body of dielectric material having a main portion and a cover portion, the main portion including a socket for receiving the panel, a rear wall, a floor, a pair of spaced side walls providing a cell and an opening in open communication with the cell and the socket, the cover portion hingedly connected to one of the walls and movable between an open position in which the cover portion does not cover the cell and a closed position in which the cover portion covers the cell. The cover portion has strain relief resilient projection means adapted, when the cover portion is in the closed position, to engage the insulation of a wire in the cell, to provide strain relief.

DESCRIPTION OF THE PREFERRED EMBODIMENT

Figures 1, 6:
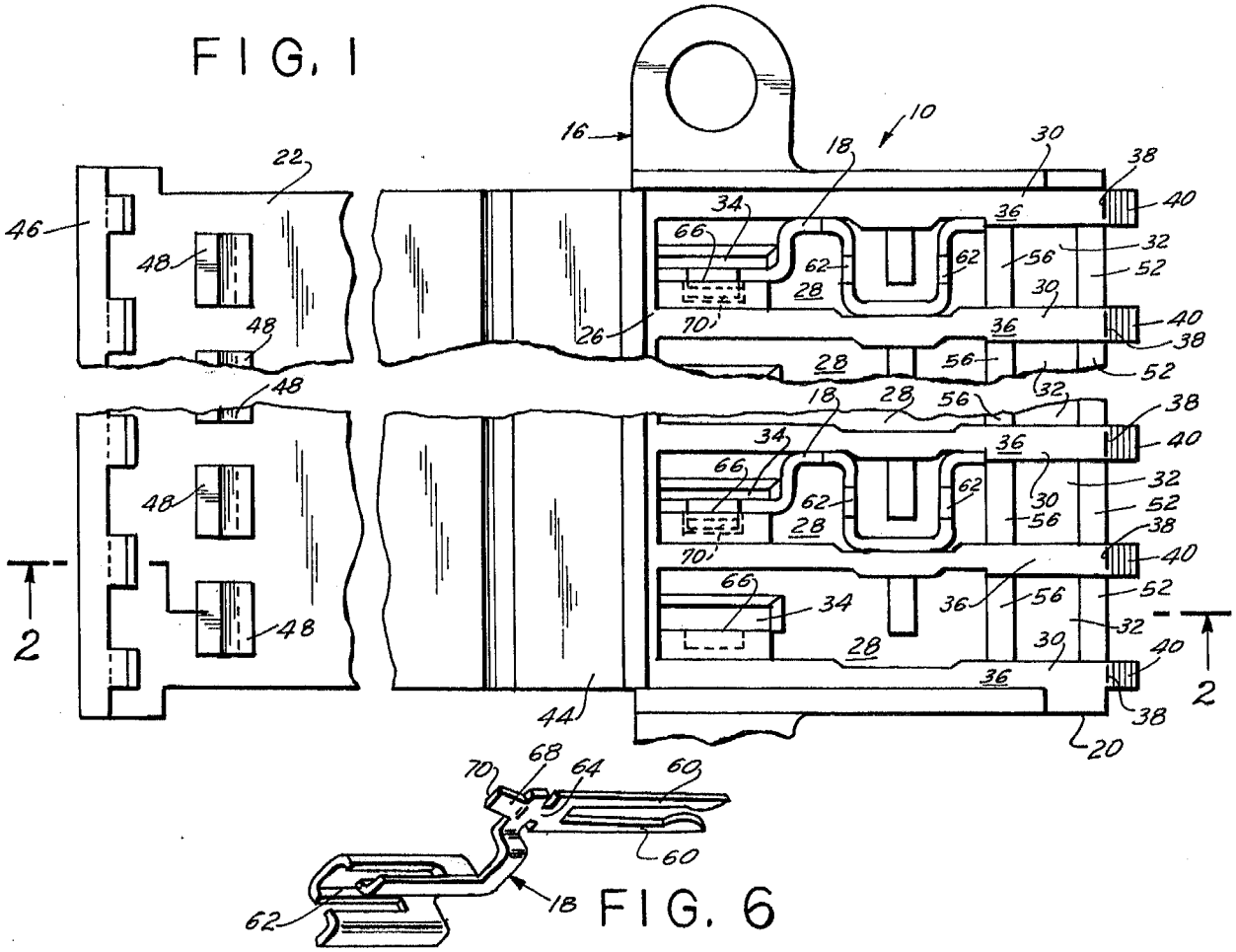
FIG. 1 is a partly fragmentary plan view of a connector body with the cover portion in the open position, showing also terminals in some cells.
FIG. 6 is a perspective view of a terminal.
Figures 2, 5:
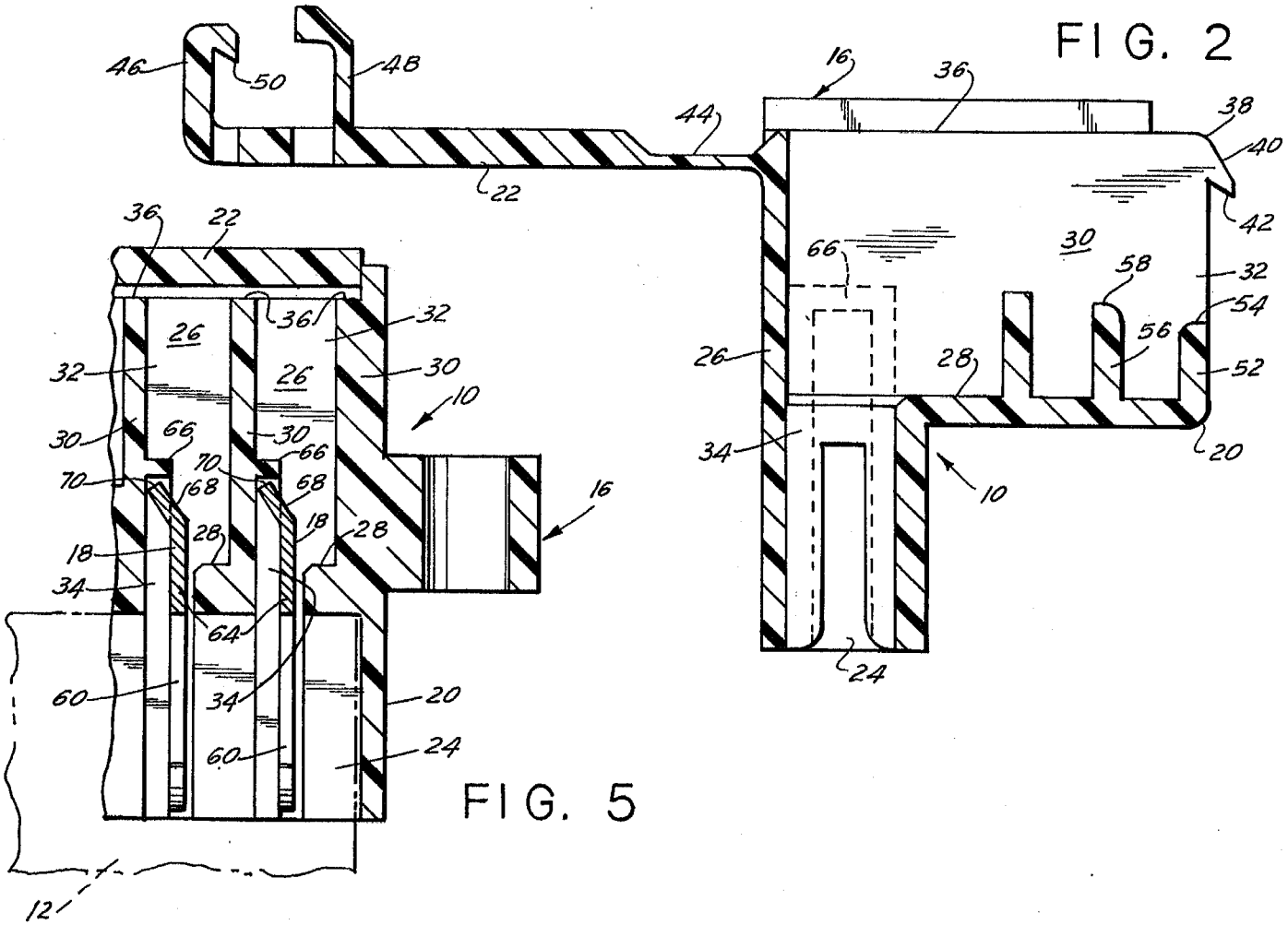
FIG. 2 is a view on line 2—2 of FIG. 1.
FIG. 5 is a view on line 5—5 of FIG. 4 and showing the printed circuit board in phantom.
Figure 3:
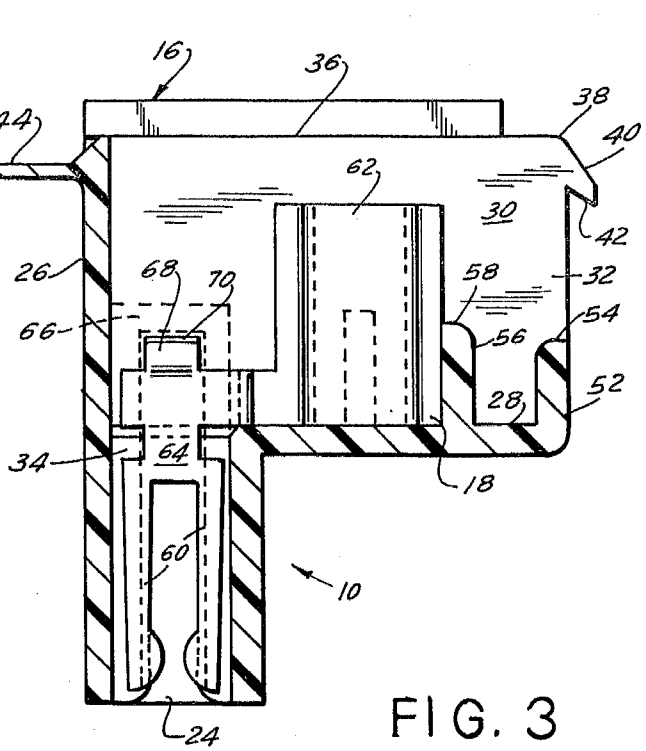
FIG. 3 is a view similar to FIG. 2 but showing a terminal in elevation.
Figure 4:
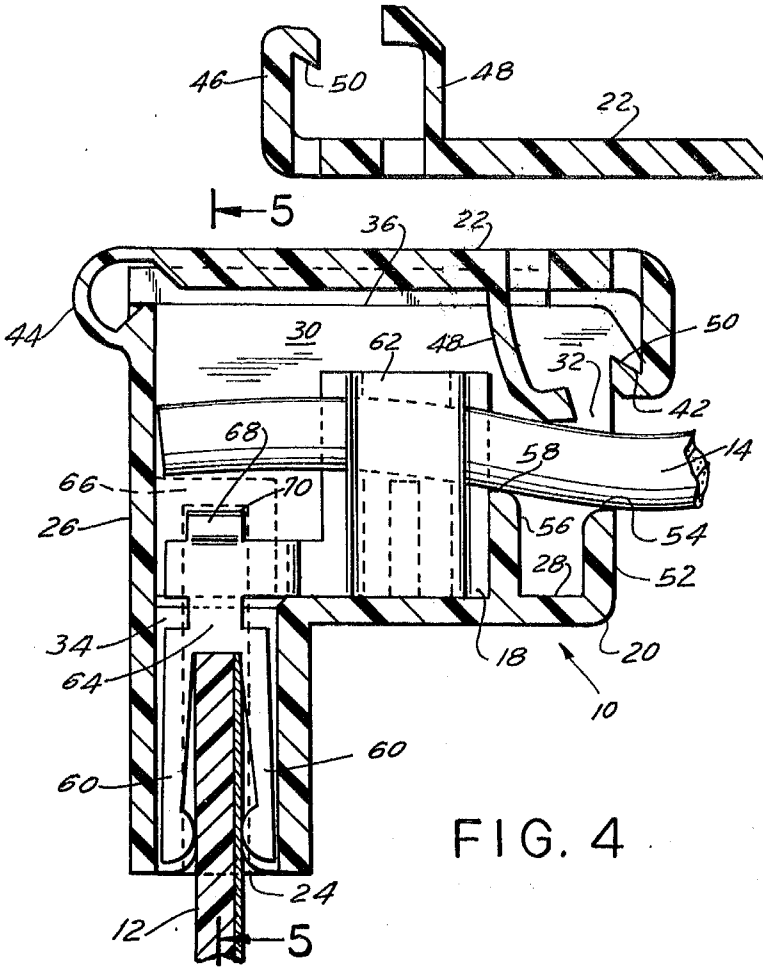
FIG. 4 is a view similar to FIG. 3 but showing the cover portion in the closed position and also showing fragmentarily a wire and a printed circuit board engaging the terminal.

The drawing shows a circuit panel connector, indicated generally at 10 (FIGS. 1, 3, 4 and 5) for electrically connecting a circuit panel, such as a printed circuit board 12 (FIGS. 4 and 5) with conductors of insulated wires, one of which is shown at 14 (FIG. 4).

Panel connector 10 comprises a one-piece connector body 16 (FIGS. 1 through 5) and a plurality of one-piece electrically conductive terminals 18 (FIGS. 1 and 3 through 6).

Connector body 16 is of dielectric material and may be molded of nylon, or any other suitable flexible plastic material. A satisfactory example of material for connector body 16 is that nylon commercially available under the designation Zytel 101. Connector body 16 has a main portion 20 and a cover portion 22.

Main portion 20 includes an elongate socket 24 for receiving an edge of board 12, an elongate rear wall 26 extending in the same direction as socket 24, a floor 28 perpendicular to rear wall 26 and a plurality of spaced parallel side walls 30, each unitary with and perpendicular to rear wall 26 and floor 28. Each pair of adjacent side walls 30 provides main portion 20 with a cell 32.

An opening 34 is associated with each cell 32 and joins its cell 32 and socket 24, in open communication with both.

Each side wall 30 has an upper edge 36 remote from and parallel to floor 28 and having a corner 38 remote from rear wall 26 and from floor 28. Each corner 38 is provided with a projection 40 having an eave 42 confronting floor 28 and inclined with respect to the plane of floor 28 so as to approach that plane in the direction away from rear wall 26. The angle of such inclination may be on the order of 30°.

Cover portion 22 is resiliently hingedly connected by a web 44 of reduced thickness to rear wall 26 along an edge thereof remote from and parallel to floor 28 and movable between an open position (FIGS. 1, 2 and 3) in which cover portion 22 does not cover cells 32 and cover portion 22 and side walls 30 extend in opposite directions from rear wall 26 and a closed position (FIGS. 4 and 5) in which cover portion 22 covers cells 32, overlying upper edges 36 of side walls 30.

Cover portion 22 has latching and strain relief resilient projection means 46 and 48, respectively, which extend away from floor 28 when cover portion 22 is in the open position and toward floor 28 when cover portion 22 is in the closed position.

Latching projection means 46 has a configuration providing a surface 50 adapted for latching interengagement with eaves 42 to hold cover portion 22 in the closed position.

Strain relief projection means 48 is located closer to rear wall 26 than is latching projection means 46 and is adapted, when cover portion 22 is in the closed position, to engage the insulation of wire 14, to provide strain relief.

Main portion 20 has a front wall 52 defining the ends of cells 32 remote from rear wall 26. Front wall 52 is spaced from and parallel to rear wall 26 and extends upwardly from floor 28 and has a top 54. Main portion 20 also has an intermediate wall 56 in each cell 32 parallel to and spaced from and between rear wall 26 and front wall 52. Intermediate wall 56 has a top 58. Tops 54 and 58 are parallel to floor 28, top 58 being further from floor 28 than top 54. More particularly with respect to the strain relief feature, strain relief projection means 48 is adapted to clamp the insulation of wire 14 against tops 54 and 58, tending to force wire 14 into a depression between front and intermediate walls 52 and 56, respectively.

Still more particularly with respect to the strain relief feature, as cover portion 22 is moved to the closed position and strain relief projection means 48 engages the insulation of wire 14, strain relief projection means 48 undergoes resilient flexure which occurs in the direction away from rear wall 26. The magnitude of the flexure automatically increases with increases in the transverse external dimension of wire 14, so that, within certain limits of such transverse external dimension, self-adjusting strain relief is automatically provided. For example, self-adjusted strain relief can be provided for various wire sizes, such as #20, #18, #16 and #14 AWG, both solid and stranded.

Each terminal 18 has a first bifurcated portion 60 in socket 24 for receiving panel or board 12, a second bifurcated portion 62 in cell 32 for receiving wire 14 in insulation-piercing conductor-engaging relationship and a connecting portion 64 in opening 34 and joining first and second bifurcated portions 60 and 62.

Connector body 16 has in its main portion 20 in each cell 32 a shelf portion 66 projecting from one of the two side walls 30 associated with that cell 32 and overhanging opening 34 and spaced above floor 28. Shelf portion 66 captures terminal 18 in the following manner. First bifurcated portion 60 defines a plane and terminal 18 has an ear portion 68 having a normal position in which it is bent obliquely out of such plane and has a free end 70 between shelf portion 66 and opening 34. To assemble terminal 18 and connector body 16, first bifurcated portion 60 is pushed into hole 34. Ear portion 68 engages shelf portion 66 and is resiliently bent thereby toward the plane of first bifurcated portion 60. When ear portion 68 passes shelf portion 66, ear portion 68 snaps back to its normal position, so that free end 70 of ear portion 68 is between shelf portion 66 and opening 34, thus to capture terminal 18.

With terminal 18 installed as aforesaid and with cover portion 22 in the open position, wire 14 is placed in cell 32 with the end of wire 14 adjacent rear wall 26. Wire 14 is then pressed down, as by use of a suitable tool (not shown), into second bifurcated terminal portion 62 which receives wire 14 in insulation-piercing, conductor-engaging relationship as aforesaid. Cover portion 22 is then moved to the closed position in which, also as aforesaid, cover portion 22 is held by virtue of the latching interengagement of eaves 42 and surfaces 50, and further in which strain relief projection means 48 engages the insulation of wire 14 and thus automatically provides the self-adjusting strain relief feature.

Panel or board 12 may then be pressed into first bifurcated terminal portion 60, resiliently spreading the tines thereof as shown in FIG. 4.

The invention attains the objects and advantages mentioned above, and others.

The disclosed details are exemplary only and are not to be taken as limitations on the invention, except as those details may be included in the appended claims.

The embodiments of the invention in which an exclusive property or privilege is claimed are defined as follows:

1. A circuit panel connector for electrically connecting a circuit panel, such as a printed circuit board, with an insulated wire, said panel connector comprising a one-piece connector body of dielectric material having a main portion and a cover portion, said main portion including a socket for receiving said panel, a rear wall, a floor, a pair of spaced side walls each unitary with said rear wall and with said floor and providing said main portion with a cell, an opening in open communication with said cell and with said socket, at least one of said side walls having a corner remote from said rear wall and from said floor and provided with a projection having an eave confronting said floor, said cover portion hingedly connected to said rear wall along an edge thereof remote from said floor and movable between an open position in which said cover portion does not cover said cell and a closed position in which said cover portion covers said cell, said cover portion having latching and strain relief resilient projection means, said latching projection means having a configuration adapted for latching interengagement with said eave to hold said cover portion in said closed position and said strain relief projection means located closer to said rear wall than said latching projection means and adapted, when said cover portion is in the closed position, to engage the insulation of a wire in said cell and undergo resilient flexure as said cover portion is moved to the closed position and said strain relief projection means engages the insulation of said wire in said cell, to provide strain relief.

2. The invention of claim 1 wherein said eave is inclined with respect to the plane of said floor so as to approach said plane in the direction away from said rear wall.

3. The invention of claim 1 wherein said main portion includes a front wall extending from said floor and spaced from said rear wall and having a top and an intermediate wall extending into said cell from said floor and between said rear wall and said front wall and having a top, said strain relief projection means of said cover portion adapted to clamp the insulation of said wire in said cell against said tops of said front and intermediate walls and tending to force said wire into a depression between said front wall and said intermediate wall.

4. The invention of claim 1 wherein said flexure occurs in the direction away from said rear wall and the magnitude of said flexure automatically increases with increases in the transverse external dimension of said wire in said cell, to provide selfadjusting strain relief.

5. The invention of claim 1 wherein said connector body has a plurality of said cells and a like plurality of said openings.

6. A circuit panel connector comprising a connector body as claimed in claim 1 and a one-piece electrically conductive terminal having a first bifurcated portion in said socket for receiving said panel, a second bifurcated portion in said cell for receiving said wire in insulation-piercing, conductor-engaging relationship and a connecting portion in said opening.

7. The invention of claim 1 wherein said connector body has a shelf portion in said cell projecting from one of said side walls and overhanging said opening and spaced from said floor, for capturing an electrically conductive terminal.

8. The invention of claim 6 wherein said connector body has a shelf portion in said cell projecting from one of said side walls and overhanging said opening, said first bifurcated portion defines a plane and said terminal has an ear portion bent obliquely out of said plane and having a free end between said shelf portion and said opening, thus to capture said terminal.

9. The invention of claim 7, also including a one-piece electrically conductive terminal having a first bifurcated portion defining a plane and adapted to be in said socket for receiving said panel, a second bifurcated portion adapted to be in said cell for receiving said wire in insulation-piercing, conductor-engaging relationship, a connecting portion adapted to be in said opening and a resilient ear portion having a normal position bent obliquely out of said plane and having a free end and adapted to be resiliently bent toward said plane by said shelf portion and thereupon to return to its normal position after passing said shelf portion, so that said free end of said ear portion is between said shelf portion and said opening, thus to capture said terminal.

10. A circuit panel connector for electrically connecting a circuit panel, such as a printed circuit board, with an insulated wire, said panel connector comprising a connector body of dielectric material having a main portion and a cover portion, said main portion including a socket for receiving said panel, a rear wall, a floor, a pair of spaced side walls providing said main portion with a cell and an opening in open communication with said cell and with said socket, said cover portion hingedly connected to one of said walls and movable between an open position in which said cover portion does not cover said cell and a closed position in which said cover portion covers said cell, said cover portion having strain resilient projection means adapted, when said cover portion is in the closed position, to engage the insulation of a wire in said cell and undergo resilient flexure as said cover portion is moved to the closed position and said strain relief projection means engages the insulation of said wire in said cell, to provide strain relief.

11. The invention of claim 10 wherein said flexure occurs in the direction away from said rear wall and the magnitude of said flexure automatically increases with increases in the transverse external dimension of said wire in said cell, to provide self-adjusting strain relief.

12. A circuit panel connector for electrically connecting a circuit panel, such as a printed circuit board, with an insulated wire, said panel connector comprising a connector body of dielectric material having a main portion and a cover portion, said main portion including a socket for receiving said panel, a rear wall, a floor, a pair of spaced side walls providing said main portion with a cell and an opening in open communication with said cell and with said socket, said cover portion hingedly connected to one of said walls and movable between an open position in which said cover portion does not cover said cell and a closed position in which said cover portion covers said cell, said cover portion having strain relief resilient projection means adapted, when said cover portion is in the closed position, to engage the insulation of a wire in said cell, to provide strain relief, said connector body also having a shelf portion in said cell projecting from one of said side walls and overhanging said opening and spaced from said floor, for capturing an electrically conductive terminal.

13. The invention of claim 12 also including a one-piece electrically conductive terminal having a first bifurcated portion defining a plane and adapted to be in said socket for receiving said panel, a second bifurcated portion adapted to be in said cell for receiving said wire in insulation-piercing, conductor-engaging relationship, a connecting portion adapted to be in said opening and a resilient ear portion having a normal position bent obliquely out of said plane and having a free end and adapted to be resiliently bent toward said plane by said shelf portion and thereupon to return to its normal position after passing said shelf portion, so that said free end of said ear portion is between said shelf portion and said opening, thus to capture said terminal.

14. A circuit panel connector for electrically connecting a circuit panel, such as a printed circuit board, with an insulated wire, said panel connector comprising a one-piece connector body of dielectric material having a main portion and a cover portion, said main portion including a socket for receiving said panel, a rear wall, a floor, a pair of spaced side walls each unitary with said rear wall and with said floor and providing said main portion with a cell, an opening in open communication with said cell and with said socket, at least one of said side walls having a corner remote from said rear wall and from said floor and provided with a projection having an eave confronting said floor, said cover portion hingedly connected to said rear wall along an edge thereof remote from said floor and movable between an open position in which said cover portion does not cover said cell and a closed position in which said cover portion covers said cell, said cover portion having latching and strain relief resilient projection means, said latching projection means having a configuration adapted for latching interengagement with said eave to hold said cover portion in said closed position and said strain relief projection means located closer to said rear wall than said latching projection means and adapted, when said cover portion is in the closed position, to engage the insulation of a wire in said cell, to provide strain relief, said connector body also having a shelf portion in said cell projecting from one of said side walls and overhanging said opening and spaced from said floor, for capturing an electrically conductive terminal.

15. The invention of claim 14, also including a one-piece electrically conductive terminal having a first bifurcated portion defining a plane and adapted to be in said socket for receiving said panel, a second bifurcated portion adapted to be in said cell for receiving said wire in insulation-piercing, conductor-engaging relationship, a connecting portion adapted to be in said opening and a resilient ear portion having a normal position bent obliquely out of said plane and having a free end and adapted to be resiliently bent toward said plane by said shelf portion and thereupon to return to its normal position after passing said shelf portion, so that said free end of said ear portion is between said shelf portion and said opening, thus to capture said terminal.

* * * * *

UNITED STATES PATENT AND TRADEMARK OFFICE

CERTIFICATE OF CORRECTION

PATENT NO. : 4,226,494

DATED : October 7, 1980

INVENTOR(S) : Charles F. Mazzeo and Catherine K. Cotler

It is certified that error appears in the above-identified patent and that said Letters Patent are hereby corrected as shown below:

In the ABSTRACT, second column, line 5 "ech" should read --each--.

Column 4, line 44 delete "selfadjusting" and insert --self-adjusting--.

Signed and Sealed this

*Seventeenth* Day of *March 1981*

[SEAL]

*Attest:*

RENE D. TEGTMEYER

*Attesting Officer*

*Acting Commissioner of Patents and Trademarks*